US006509676B1

(12) United States Patent
Durling

(10) Patent No.: US 6,509,676 B1
(45) Date of Patent: Jan. 21, 2003

(54) SPARK PLUG CONSTRUCTION FOR ENHANCED HEAT TRANSFER

(75) Inventor: Harold E. Durling, Elsie, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/510,789

(22) Filed: Feb. 23, 2000

(51) Int. Cl.[7] ..... H01T 13/20

(52) U.S. Cl. ..... 313/137; 313/128; 313/141; 313/144; 123/169 EL

(58) Field of Search ..... 343/137, 128, 343/141, 144; 123/169 EL

(56) References Cited

U.S. PATENT DOCUMENTS

| | | | | |
|---|---|---|---|---|
| 4,219,001 A | * | 8/1980 | Kumagai et al. | 123/169 EL |
| 4,400,643 A | * | 8/1983 | Nishio et al. | 313/11.5 |
| 4,406,968 A | * | 9/1983 | Friese et al. | 313/136 |
| 5,017,826 A | * | 5/1991 | Oshima et al. | 313/142 |
| 5,877,584 A | | 3/1999 | Kato et al. | |

* cited by examiner

*Primary Examiner*—Thomas M. Sember
*Assistant Examiner*—Jacob Y. Choi
(74) *Attorney, Agent, or Firm*—Vincent A. Cichosz

(57) ABSTRACT

A spark plug having enhanced heat transfer capabilities is provided. The spark plug comprises a tubular insulator body, a center electrode and a thermally conductive filler material. The tubular insulator body has an inner surface, and the center electrode has an outer surface. The center electrode is positioned within the tubular insulator body such that a gap is formed between at least a portion of the inner surface of the tubular insulator body and at least a portion of the outer surface of the center electrode. The thermally conductive filler material has a high heat transfer coefficient. It is positioned within at least a portion of the gap so as to intimately contact the inner surface of the tubular insulator body and the outer surface of the center electrode. Positioned accordingly in the gap, the thermally conductive filler material enhances the ability of the spark plug to transfer heat away from the firing tip and into the body of the spark plug. This enables a designer to employ performance-improving features in a spark plug without the compromises inherent in currently used spark plug designs.

21 Claims, 2 Drawing Sheets

SPARK PLUG CONSTRUCTION FOR ENHANCED HEAT TRANSFER

FIELD OF THE INVENTION

The invention relates, in general, to spark plugs for use within a main combustion chamber of an internal combustion engine. More particularly, the invention pertains to spark plugs having enhanced capabilities to transfer heat away from the firing tip of the spark plug into the body of the plug. This additional cooling of the firing tip enables the plug designer to use performance-improving features without the compromises inherent in currently used spark plug designs.

BACKGROUND OF THE INVENTION

A spark plug is a device, inserted into the combustion chamber of an engine, containing a side electrode and an insulated center electrode spaced to provide a gap for firing an electrical spark to ignite air-fuel mixtures. The high-voltage burst from the coil via the distributor is received at the terminal of the spark plug and conducted down a center electrode protected by an insulator. At the bottom of the plug, which projects into the cylinder, the voltage must be powerful enough to jump a gap between the center and side electrodes through a thick atmosphere composed of the air-fuel mixture. When the spark bridges the gap, it ignites the fuel within the cylinder.

Typical spark plug designs, as illustrated in FIG. 1, employ a metallic center electrode that is slidingly fitted into a ceramic insulator to form the structure of the plug. This electrode is sealed in place with a glass seal/resistor material. The firing tip of the plug is heated by the combustion that occurs within the combustion chamber of the engine. The firing tip must be cooled below the ignition temperature of the air-fuel mixture. This is accomplished by heat being conducted through the insulator structure and the center electrode into the plug shell and eventually into the engine cylinder head and the coolant circulating within it. The insulator material is not as effective as a thermal conductor, as compared to the metallic center electrode. As a result, the center electrode carries away more heat than the insulator and the insulator is cooled by the electrode. Copper-cored center electrodes are typically used to promote this effect. The copper material, however, is somewhat expensive. A clearance is provided between the center electrode and the insulator. This simplifies assembly of the electrode into the insulator and compensates for expansion of the electrode during heating, as such expansion, if not compensated for, could result in cracking of the insulator. As a result of this clearance, the transfer of heat from the insulator is impeded.

Ideally, spark plug manufacturers would prefer to use a less thermally conductive material for the center electrode than copper-cored nickel. They would also prefer to use a center electrode whose diameter is physically smaller than that shown in FIG. 1. A smaller electrode would reduce the cost of the spark plug, as the cost of copper-cored nickel is relatively high. It also would be desirable to produce an electrode tip that has a small diameter so as to achieve a spark with lower applied voltages. Unfortunately, spark plug designers are hampered by the inability of these smaller diameter tips to pull heat away from the electrode tip in a quick enough manner. Additionally, an electrode having a thin diameter and/or one formed from cheaper materials would have insufficient heat transfer capabilities.

Another consideration in spark plug design is the fouling path length and how this length may be optimized with respect to the temperature of the tip. The fouling path area of the spark plug is the area of the insulator around the firing tip that gets covered with carbon and moisture. Excessive build-up of carbon and moisture prevents a spark from occurring, resulting in misfiring of the spark plug. A long fouling path length between the spark plug firing gap and the metal shell of the plug is desirable. Misfiring of the plug due to carbon deposits is less likely to occur with a longer fouling path because the carbon concentration becomes diluted due to the added length. Unfortunately, the length of the fouling path is limited by the ability to keep the firing tip of the insulator cool. This problem has been aggravated by the fact that some of the newer types of high compression or lean burn type of engines require more energy from the spark plug to cause ignition. As a result of this, the amount of carbon deposits that can be tolerated without causing misfiring has decreased. Care must therefore be taken to carefully balance the fouling path length of the plug with the resultant tip temperature in order to achieve optimum performance of the plug.

U.S. Pat. No. 5,877,584 to Kato et al. discusses the importance of maintaining a particular firing tip temperature while sufficiently reducing carbon-related deposits through optimization of a plurality of parameters. These parameters include the fouling path length or gap length (H) between the electrode tip and the insulator, the tip diameter (D1), and the width of the space (L) between the outer surface of the center electrode and the inner wall of the insulator.

Additionally, some of the newer types of engines require a spark plug that has a cooler tip surface. Due to these requirements, there are currently approximately six different spark plug designs that allow for different heat ranges for the plug. If the tip surface of a plug is too hot for a particular engine, then the air-fuel mixture can self-ignite. This would adversely affect control of engine timing, and could lead to failure of the spark plug and/or the engine. The cooler tip temperature of these spark plug designs is achieved by sacrificing the length of the fouling path. As a result, deleterious build-up of carbon deposits on the firing tips of these spark plugs is far too common.

OBJECTIVES OF THE INVENTION

It is therefore an objective of the invention to produce a spark plug having enhanced heat transfer capabilities.

Another objective is to produce a spark plug having enhanced heat transfer capabilities that allow for improvement of other spark plug performance characteristics.

A further objective is to produce a spark plug having a wire of small diameter as the center electrode so as to achieve a variety of advantages. These advantages include a cost savings in the reduction of materials required to form the electrode, the ability to produce a spark at lower voltages, and the ability to ignite leaner or more dilute air-fuel mixtures.

Yet another objective is to produce a spark plug having a thermally conductive filler material that provides intimate thermal contact between the center electrode and the body of the ceramic insulator.

An additional objective is to produce a spark plug having a thermally conductive material that is formed from a material whose coefficient of thermal expansion substantially equal to a coefficient of thermal expansion of the insulator body.

Yet another objective is to produce a spark plug that carefully balances the length of the fouling path with the temperature of the firing tip of the spark plug.

Still another objective is to produce a spark plug having a longer fouling path than those currently in production.

Still yet another objective is to produce a cold heat range spark plug having enhanced heat transfer capabilities without sacrificing the length of the fouling path.

In addition to the objectives and advantages listed above, various other objectives and advantages of the invention will become more readily apparent to persons skilled in the relevant art from a reading of the detailed description section of this document. The other objective and advantages will become particularly apparent when the detailed description is considered along with the drawing and claims presented herein.

SUMMARY OF THE INVENTION

Briefly, and in accordance with the forgoing objectives, the invention comprises a tubular insulator body, a center electrode and a thermally conductive filler material. The tubular insulator body has an inner surface, and the center electrode has an outer surface. The center electrode is positioned within the tubular insulator body such that a gap is formed between at least a portion of the inner surface of the tubular insulator body and at least a portion of the outer surface of the center electrode. The thermally conductive filler material has a high heat transfer coefficient. It is positioned within at least a portion of the gap so as to intimately contact the inner surface of the tubular insulator body and the outer surface of the center electrode. Positioned accordingly in the gap, the thermally conductive filler material enhances the ability of the spark plug to transfer heat away from the firing tip and into the body of the spark plug.

DETAILED DESCRIPTION OF THE INVENTION

Figure 1:
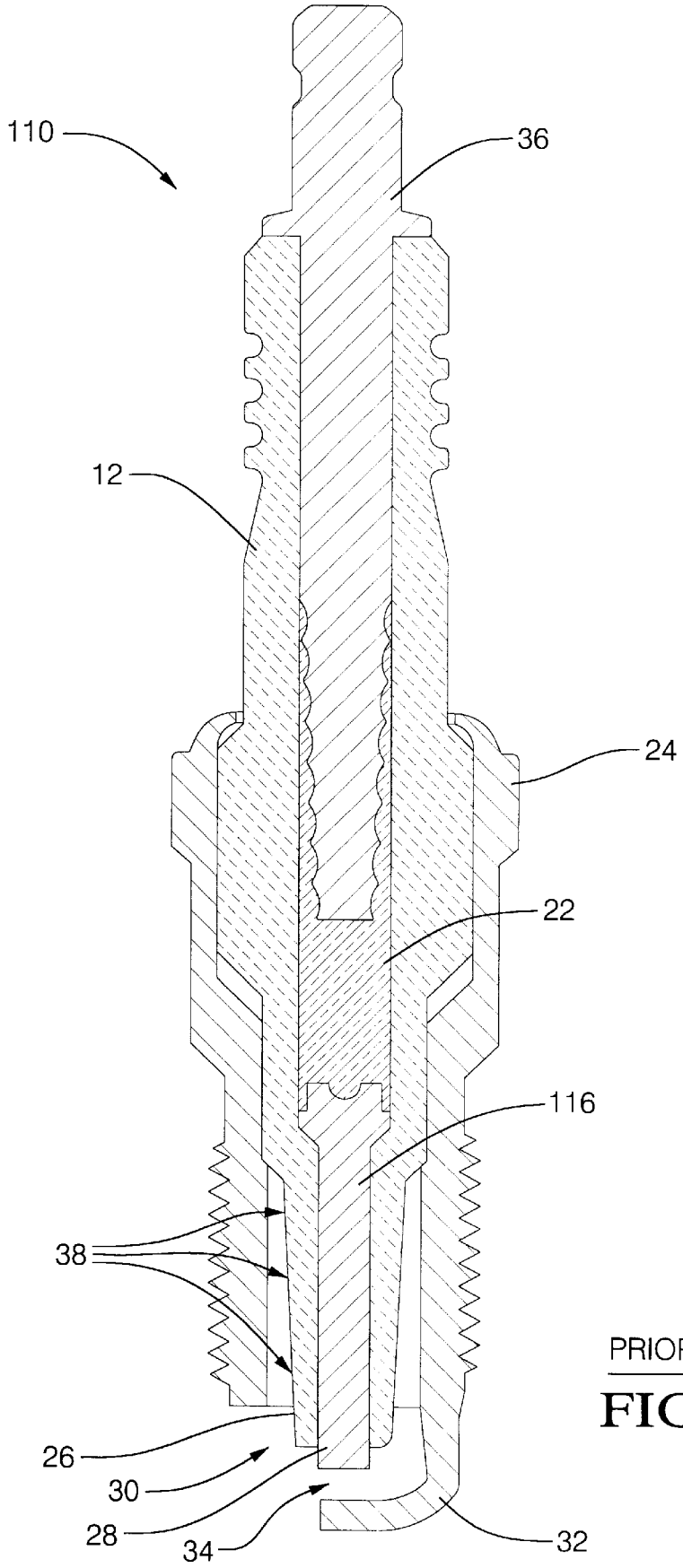
PRIOR ART FIG. 1
FIG. 1 shows a cross-sectional side view of a spark plug according to the prior art.

Before describing the invention in detail, the reader is advised that, for the sake of clarity and understanding, identical components having identical functions have been marked where possible with the same reference numerals in each of the Figures provided in this document.

Referring now to FIG. 1, there is shown cross-sectional side view of a spark plug, generally indicated as 110, according to the prior art. Typically, these spark plug designs use a metallic center electrode 116 that slidingly fits into a tubular ceramic insulator body 12 to form the structure of the spark plug 110. The electrode 116 is sealed in place with a glass seal/resistor material 22. The glass seal/resistor material 22 also secures a terminal post 36 within an upper portion of the tubular insulator body 12. An end portion 28 of the center electrode 116 and an end portion 26 of the insulator body 12 forms a firing tip, generally indicated as 30, for the spark plug. A metal shell 24 is positioned around at least a portion of the tubular insulator body 12, and a ground electrode 32 is attached to this metal shell 24 and positioned a predetermined distance from the firing tip 30 so as to form a spark gap 34. The fouling path, which is the area of the insulator around the firing tip 30 that gets covered with carbon and moisture during firing of the plug 110, is designated as 38.

The present invention enhances the heat transfer capabilities of the spark plug. Specifically, the invention increases the amount of heat that can be transferred away from the firing tip 30 and into the body of the spark plug and eventually into the coolant via the walls of cylinder head. The additional cooling of the firing tip allows the plug designer to consider using performance-improving features without the compromises inherent in other currently used spark plugs.

Figure 2:
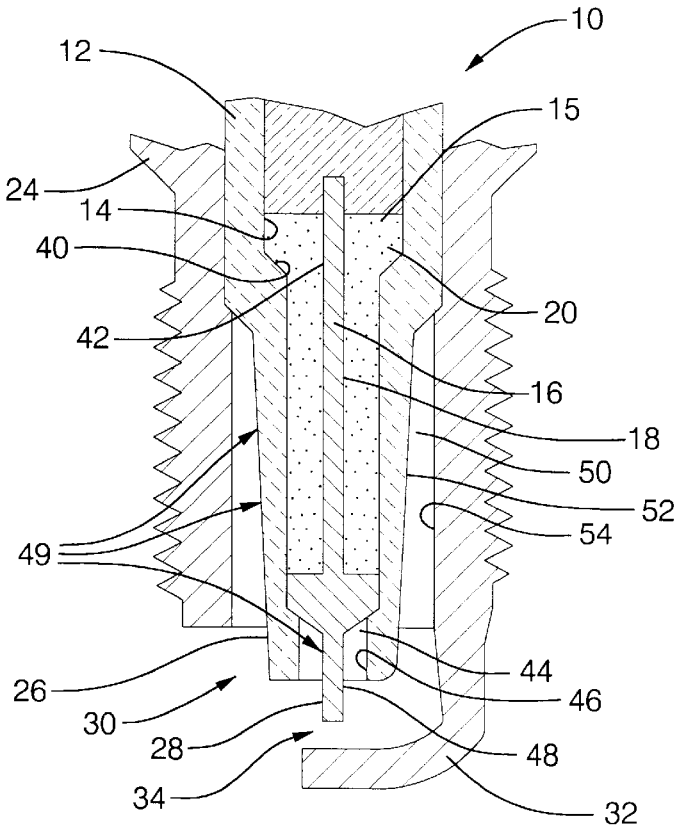
FIG. 2 shows a cross-sectional side view of the firing tip portion of a spark plug according to the invention, incorporating an example of one of the performance enhancing features that can be implemented due to the improved heat transfer capabilities of the spark plug.
Figure 3:
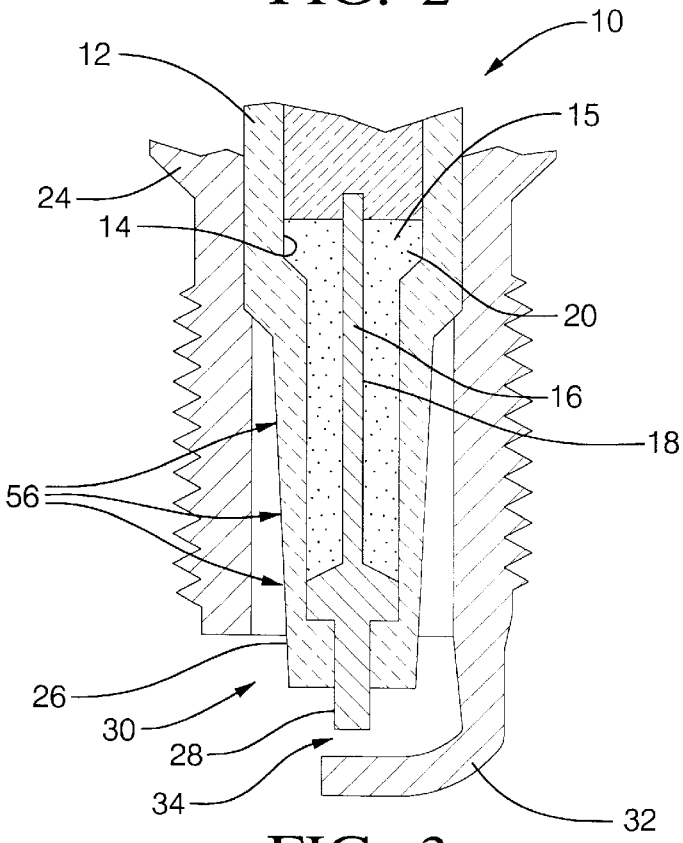
FIG. 3 shows a cross-sectional side view of the firing tip portion of a spark plug according to the invention, incorporating an example of another one of the performance enhancing features that can be implemented due to the improved heat transfer capabilities of the spark plug.

As illustrated in FIGS. 2 and 3, the invention produces a spark plug, generally designated as 107 having enhanced heat transfer capabilities. The spark plug 10 comprises a tubular insulator body 12, a center electrode 16 and a thermally conductive filler material 20. The tubular insulator body 12 has an inner surface 14, and the center electrode 16 has an outer surface 18. The center electrode 16 has a much smaller diameter, similar to that of a wire, than the center electrode 116 of the prior art. The center electrode 16 is positioned within the tubular insulator body 12 such that an opening 15 is formed between at least a portion of the inner surface 14 of the tubular insulator body 12 and at least a portion of the outer surface 18 of the center electrode 16.

The thermally conductive material 20 is positioned within at least a portion of the opening 15 formed between at least a portion of the inner surface 14 of tubular insulator body 12 and at least a portion of the outer surface 18 of center electrode 16. The thermally conductive filler material 20 imparts enhanced heat transfer capabilities to the spark plug 10.

The thermally conductive filler material 20 comprises a flowable material, preferably a powder mixture, which can be packed into the opening 15 to fill all of the voids between the outer surface 18 of center electrode 16 and the inner surface 14 of tubular insulator body 12. It should be packed within the opening 15 to displace any air within the insulator body and to physically and/or intimately contact the inner surface 14 of insulator body 12, the outer surface 18 of center electrode 16 as well as the glass seal 22. This type of intimate contact will promote maximum heat transfer from the firing tip into the structure of the spark plug 10 and eventually into the coolant circulating within the walls of the cylinder head.

A special feature of this invention is that the thermally conductive filler material 20 is a powder mixture that is blended from two or more constituents selected so that the thermal expansion coefficient of the mixture 20 closely matches the thermal expansion coefficient of the material of which the tubular insulator body 12 is formed. This feature prevents cracking of the insulator body 12 upon expansion of filler material 20 during heating of the spark plug 10. Consequently, the powder constituents are chosen for high thermal conductivity characteristics, as well as low cost and stable chemical structures.

The powder mixture should include a material having a high heat transfer coefficient such as copper, silver, gold, and/or alloys thereof. The ingredients from which the powder mixture may be formed include copper and graphite. A variety of other combinations, however, may be used. Listed below are certain properties of copper and graphite as pure substances. The properties of the insulator material from which the body of the spark plug is typically formed are also listed below:

| MATERIAL | Coefficient of Thermal Expansion (consistent units) | Thermal Conductivity (consistent units) |
|---|---|---|
| Copper | 16.5 | 3.94 |
| Graphite | 0.6–4.3 | 1.0–1.6 |
| Alumina (spark plug body) | 9 | 0.29 |

Graphite comes in many forms and exhibits a variety of physical properties. If average values are assumed, however, a mixture comprising equal parts of copper powder and graphite (by volume) would be expected to have a coefficient of thermal expansion closely matching that exhibited by alumina, a typical spark plug body material. Additionally, the thermal conductivity of the mixture should lie between that of copper and graphite. This would make it much higher than alumina and vastly superior to air for conducting heat. Mixtures of finely divided metal and graphite simultaneously provide the properties of high thermal conductivity, the ability to flow into confined spaces, and the thermal expansion characteristics matching those of the material used to make the insulators for spark plugs.

In addition to providing the above described heat transfer capabilities to the spark plug 10, the thermally conductive filler material 20 may be used for securing the center electrode 16 within the tubular insulator body 12, as illustrated in FIG. 3. This feature inherently reduces the length of the center electrode wire 16 and the amount of material needed to form the electrode. It therefore also reduces the cost to manufacture the spark plug 10.

The use of the thermally conductive filler material 20 of the invention would enable spark plug manufacturers to use for the center electrode 16 a less thermally conductive material than copper-cored nickel. It would also enable them to use a center electrode 16 having a smaller diameter, such as an electrode wire, as a means to reduce cost of the spark plug, as copper-cored nickel is expensive. Additionally, the invention would allow one to produce an electrode tip that has a small diameter so as to achieve a spark with lower applied voltages. By employing this feature that results in additional cooling of the electrode tip, the spark plug designer may then employ various other performance-improving features without the compromises inherent in currently used spark plug designs.

One example of a performance-enhancing feature that can be implemented due to the improved heat transfer capabilities of the spark plug is illustrated in FIG. 2. In this example, the center electrode 16 is positioned within the tubular insulator body 12 so as to form a first opening 15 between a first portion 40 of the inner surface 14 of tubular insulator body 12 and a first portion 42 of the outer surface 18 of center electrode 16 within which the thermally conductive filler material 20 is placed. A second opening 44 is formed between a second portion 46 of the inner surface 14 of tubular insulator body 12 and a second portion 48 of the outer surface 18 of center electrode 16. The metal shell 24 is positioned around at least a portion of the tubular insulator body 12 such that a third opening 50 is formed between an outer surface of a lower portion 52 of tubular insulator body 12 and an inner surface of a lower portion 54 of tubular metal shell 24. The second opening 44 and the third opening 50 operate together to form a fouling path 49 that is longer in length than those currently available on the market.

Another example of a performance-enhancing feature that can be implemented due to the improved heat transfer capabilities of the spark plug is illustrated in FIG. 3. This embodiment shows a spark plug having a cold heat range while maintaining a normal fouling path length 56 similar to the fouling path length 38 as shown in the prior art spark plug 110 of FIG. 1. In the past, cold heat range spark plugs had to have a shortened fouling path length in order to achieve a high heat transfer from the firing tip 30 of the plug. However, the use of the thermally conductive filler material 20 of the present invention provides the necessary heat transfer from the firing tip 30 so that a normal length fouling path length 56 may be maintained.

Two examples have thus far been disclosed as to how the performance characteristics of a spark plug may be improved upon through use of the enhanced heat transfer capabilities of the invention. Nevertheless, improvements in many other performance characteristics may be gleaned through experimentation and optimization of the subject matter disclosed herein.

The invention has been described in such full, clear, concise and exact terms so as to enable any person skilled in the art to which it pertains to make and use the same. It should be understood that variations, modifications, equivalents and substitutions for components of the specifically described embodiments of the invention may be made by those skilled in the art without departing from the spirit and scope of the invention as set forth in the appended claims. Persons who possess such skill will also recognize that the foregoing description is merely illustrative and not intended to limit any of the ensuing claims to any particular narrow interpretation.

I claim:

1. A spark plug having enhanced heat transfer capabilities, said spark plug comprising:

(a) a tubular insulator body having an inner surface;

(b) a center electrode having an outer surface, said center electrode positioned within said tubular insulator body such that an opening is formed between at least a portion of said inner surface of said tubular insulator body and at least a portion of said outer surface of said center electrode; and (c) a thermally conductive filler material positioned within at least a portion of said opening formed between at least a portion of said inner surface of said tubular insulator body and at least a portion of said outer surface of said center electrode, said thermally conductive filler material comprising a mixture having a coefficient of thermal expansion substantially equal to a coefficient of thermal expansion of said tubular insulator body so as to prevent cracking of said tubular insulator body upon expansion of said thermally conductive filler material during heating of said spark plug, said thermally conductive filler material imparting enhanced heat transfer capabilities to said spark plug.

2. The spark plug recited in claim 1 wherein said thermally conductive filler material comprises a flowable material which can be placed into said opening to fill voids and displace any air within said tubular insulator body and to physically contact said at least a portion of said inner surface of said tubular insulator body and said at least a portion of said outer surface of said center electrode.

3. The spark plug as recited in claim 2 wherein said thermally conductive filler material comprises a powder mixture which can be packed into said opening so as to intimately contact said at least a portion of said inner surface of said tubular insulator body and said at least a portion of said outer surface of said center electrode.

4. The spark plug having enhanced heat transfer capabilities as recited in claim 1 wherein said tubular insulator body comprises ceramic material.

5. The spark plug as recited in claim 1 wherein said thermally conductive filler material comprises a mixture including a material having a high heat transfer coefficient.

6. The spark plug as recited in claim 5 wherein said material having a high heat transfer coefficient is selected from the group consisting of copper, silver, gold, and alloys thereof.

7. The spark plug as recited in claim 6 wherein said mixture comprises a powdered copper mixture.

8. The spark plug as recited in claim 7 wherein said powdered copper mixture includes graphite.

9. The spark plug as recited in claim 1 including a means for securing said center electrode within said tubular insulator body.

10. The spark plug as recited in claim 9 wherein said means for securing said center electrode within said tubular insulator body comprises said thermally conductive filler material.

11. The spark plug as recited in claim 9 wherein said means for securing said center electrode within said tubular insulator body comprises a glass seal/resistor material.

12. The spark plug as recited in claim 11 wherein said thermally conductive filler material provides intimate thermal contact between said tubular insulator body, said center electrode and said glass seal/resistor material to promote maximum heat transfer from a firing tip of said spark plug into said spark plug.

13. The spark plug as recited in claim 12 wherein said glass seal/resistor material secures a terminal post within an upper portion of said tubular insulator body.

14. The spark plug as recited in claim 1 wherein an end portion of said center electrode and an end portion of said tubular insulator body forms a firing tip.

15. The spark plug as recited in claim 14 further including a metal shell positioned around at least a portion of said tubular insulator body.

16. The spark plug as recited in claim 14 further including a ground electrode attached to said metal shell and positioned a predetermined distance from said firing tip so as to form a spark gap.

17. The spark plug as recited in claim 1 wherein said center electrode comprises a metal wire.

18. A spark plug having enhanced heat transfer capabilities, said spark plug comprising:

(a) a tubular insulator body having an inner surface;

(b) a center electrode having an outer surface, said center electrode positioned within said tubular insulator body;

(c) a first opening formed between a first portion of said inner surface of said tubular insulator body and a first portion of said outer surface of said center electrode;

(d) a second opening formed between a second portion of said inner surface of said tubular insulator body and a second portion of said outer surface of said center electrode, said second opening forming a fouling path for said spark plug; and (e) a thermally conductive filler material positioned within said first opening formed between said inner surface of said tubular insulator body and said outer surface of said center electrode, said thermally conductive filler material imparting enhanced heat transfer capabilities to said spark plug.

19. The spark plug as recited in claim 18 including a metal shell positioned around at least a portion of said tubular insulator body such that a third opening is formed between an outer surface of a lower portion of said tubular insulator body and an inner surface of a lower portion of said metal shell, said second opening and said third opening operating together to form said fouling path of an extended length.

20. The spark plug as recited in claim 18 wherein said second opening is formed by producing an electrode tip having a small diameter.

21. The spark plug as recited in claim 18 wherein said thermally conductive filler material comprises a mixture having a coefficient of thermal expansion substantially equal to a coefficient of thermal expansion of said tubular insulator body so as to prevent cracking of said tubular insulator body upon expansion of said thermally conductive filler material during heating of said spark plug.

* * * * *